US007066705B1

(12) United States Patent
Keller et al.

(10) Patent No.: US 7,066,705 B1
(45) Date of Patent: Jun. 27, 2006

(54) REAR LOADER COLLECTION VEHICLE WITH DETACHABLE CONTAINER

(75) Inventors: Mark A. Keller, Ft. Payne, AL (US); Bobby McKinney, Ft. Payne, AL (US); Marcel G. Stragier, Scottsdale, AZ (US); Gary Flerchinger, Hixson, TN (US); Henry M. Hund, Jr., Cedar Bluff, AL (US)

(73) Assignee: The Heil Company, Chattanooga, TN (US)

( * ) Notice: Subject to any disclaimer, the term of this patent is extended or adjusted under 35 U.S.C. 154(b) by 0 days.

(21) Appl. No.: 10/893,400

(22) Filed: Jul. 16, 2004

Related U.S. Application Data

(63) Continuation-in-part of application No. 10/622,530, filed on Jul. 18, 2003.

(60) Provisional application No. 60/399,942, filed on Jul. 30, 2002.

(51) Int. Cl.
*B65F 3/20* (2006.01)

(52) U.S. Cl. ..... 414/525.51; 414/525.3; 414/813

(58) Field of Classification Search ..... 414/525.3, 414/525.4, 525.5, 525.51, 525.54, 525.55, 414/813
See application file for complete search history.

(56) References Cited

U.S. PATENT DOCUMENTS

| | | | |
|---|---|---|---|
| 3,365,087 | A | 1/1968 | Roedel et al. |
| 3,370,525 | A | 2/1968 | Bowles |
| 3,380,600 | A | 4/1968 | Klanner et al. |
| 3,696,951 | A | 10/1972 | Toppins et al. |
| 3,746,192 | A | 7/1973 | Herpich et al. |
| 3,817,415 | A | 6/1974 | Lewis |
| 3,881,613 | A | 5/1975 | Torimoto et al. |
| 3,899,091 | A | 8/1975 | Smith |
| 4,096,959 | A | 6/1978 | Schaffler |
| 4,121,725 | A | 10/1978 | Demenais |
| 4,257,322 | A | 3/1981 | McDermott |
| 4,460,307 | A | 7/1984 | Durant et al. |
| 4,934,896 | A | 6/1990 | Quinto |
| 4,986,716 | A | 1/1991 | Winter |
| RE33,602 | E | 6/1991 | Smith |
| 5,562,390 | A | 10/1996 | Christenson |
| 5,725,350 | A | 3/1998 | Christenson |
| 5,938,393 | A | 8/1999 | Georg |
| 6,234,739 | B1 | 6/2001 | Smith et al. |
| 6,478,527 | B1 | 11/2002 | Silvan |
| 6,497,547 | B1 | 12/2002 | Maglaras |

*Primary Examiner*—James W. Keenan
(74) *Attorney, Agent, or Firm*—Chambliss, Bahner & Stophel, P.C.

(57) ABSTRACT

A refuse collection vehicle includes a chassis and a storage container that is detachably mounted on the chassis. The storage container has a rear wall with an opening therein and a sweep panel that is mounted in the rear wall. The sweep panel is movable between an open position which exposes the opening in the rear wall of the container and a closed position which covers the opening in the rear wall of the container. The refuse collection vehicle also includes a rear tailgate assembly that has a hopper which is adapted to receive refuse and a packer assembly which is adapted to cooperate with the sweep panel to move refuse from the hopper of the tailgate assembly into the storage. A method for loading refuse in a storage container and a storage container that is useful in practicing such method are also described.

3 Claims, 12 Drawing Sheets

REAR LOADER COLLECTION VEHICLE WITH DETACHABLE CONTAINER

CROSS REFERENCE TO RELATED APPLICATION

This application is a continuation-in-part of co-pending U.S. application Ser. No. 10/622,530, which was filed on Jul. 18, 2003 and which claims the benefit of provisional Application No. 60/399,942, which was filed on Jul. 30, 2002.

FIELD OF THE INVENTION

This invention relates generally to a rear-loading refuse collection vehicle. More particularly, the invention relates to such a collection vehicle in which a storage container for refuse may be detachably mounted on the vehicle and removed therefrom. In a preferred embodiment of the invention, the detachable storage container generally has the dimensions of a standard intermodal shipping container.

BACKGROUND AND DESCRIPTION OF THE PRIOR ART

Several different types of vehicles are commonly used for collection of household and commercial refuse. Some types of refuse collection vehicles are rear-loading, in which a packer mechanism is adapted to move refuse deposited in a hopper that is a part of the tailgate assembly into a storage compartment that is permanently mounted on the vehicle. Other types of refuse collection vehicles are front-loading or side-loading. It is also known to provide a collection vehicle in which a storage compartment or container is detachably mounted on the vehicle. Such vehicles are described in U.S. Pat. No. 3,370,525 of Bowles, U.S. Pat. No. 4,934,896 of Quinto, U.S. Pat. No. 5,562,390 of Christenson, U.S. Pat. No. 5,725,350 of Christenson and U.S. Pat. No. 5,938,393 of Georg.

In addition, U.S. Pat. No. 3,365,087 of Roedel et al. describes a rear loading vehicle with a detachably mounted storage container having a sloped rear wall that is provided with a hinged door that may be opened to provide access for deposit and compaction of refuse through the door opening. U.S. Pat. No. 3,380,600 of Klanner et al. describes a rear loading vehicle with a detachably mounted storage container and a tailgate assembly that includes support arms that are pivotally mounted to the front of the vehicle chassis in front of the removable container. U.S. Pat. No. 3,881,613 of Torimoto describes a rear loading vehicle having a detachable storage container and a tailgate assembly that is pivotally mounted to the top of a pair of vertical supports at the rear of the vehicle chassis behind the container. U.S. Pat. No. 3,817,415 of Lewis describes a rear loading vehicle with a detachably mounted storage container and a detachably mounted tailgate assembly. All of these rear loading vehicles with detachably mounted storage containers have a number of disadvantages. The storage containers of the Roedel and Klanner vehicles have no means other than sloping rear walls to prevent compacted trash from rebounding or otherwise spilling out of the container when the packing mechanisms are removed therefrom. The storage container of the Torimoto vehicle relies on a vertically mounted sliding door to prevent compacted trash from rebounding out of the container. Furthermore, the Roedel and Klanner vehicles are not susceptible to use with standardized storage containers. In addition, operation of the Klanner vehicle requires the tailgate assembly to be moved above the storage container and the container dragged from beneath the tailgate assembly in order to remove it from the vehicle. Similarly, operation of the Torimoto vehicle requires the tailgate assembly to pivot above the removable container, so that the container must be removed from the side of the vehicle with a fork lift. Although the Lewis vehicle may be used with a standardized container, its rear loader assembly must be completely disengaged from the vehicle and mounted on a support stand before the container can be removed.

Standard-sized containers (sometimes referred to as intermodal containers because many of them can be carried by various modes of transport) are widely used for transport and temporary storage of various products. Such containers include a container enclosure that is mounted within a standardized container frame which is adapted for stacking with other similar containers and (usually) for shipment by rail, truck or ship. The most common containers that are hauled by truck are 10 or 20 feet long, 8 feet wide and 8.5 feet high. Various other sizes are also in use. In order to be commercially successful, containers for intermodal shipping must be designed and built to internationally recognized standards such as those issued by the United Nations, the International Standards Organization (ISO) and the Association of American Railroads (AAR). These organizations promulgate standards for such containers relating to all facets of handling and carriage, including, among other things, strength, size, weight and materials used in the construction of the container. Applicable standards for intermodal shipping containers such as are described herein include ISO 1496/IV, AAR M-930, the United Nations' Council for Safe Containers (CSC) and Customs/TIR.

It would be desirable if a rear-loader refuse collection vehicle could be developed that could be used to store and compact refuse in a standardized removable storage container. It would also be desirable if such a vehicle could be developed that would not require the removal of the tailgate assembly or any complicated removal procedure for moving the container off of the vehicle. It would also be desirable if such a vehicle could be developed that could be operated in such a way that there would be little risk of compacted refuse rebounding or otherwise spilling out of the container.

ADVANTAGES OF THE INVENTION

Among the advantages of the invention is that it allows for use of a removable container from a rear loading refuse collection vehicle with minimal modification of the container components. Another advantage of the invention is that it does not require a complicated procedure or mechanism for moving the container off of the vehicle. Yet another advantage of the invention is that a rear loading vehicle so equipped may be operated in such a way that there is little risk of compacted refuse rebounding or otherwise spilling out of the container. Still another advantage of the invention is that it allows for removal of a storage container from the vehicle without requiring removal of the tailgate assembly from the vehicle. An advantage of a preferred embodiment of the invention is that it allows for use of such a removable container that is standardized to an intermodal configuration.

Additional objects and advantages of this invention will become apparent from an examination of the drawings and the ensuing description.

EXPLANATION OF TECHNICAL TERMS

As used herein, the term "actuator" refers to a device that imparts linear or rotational motion to a component. The term "actuator" thus includes hydraulic actuators or cylinders, pneumatic actuators, motors, motorized drives, levers, springs, gear systems and combinations thereof.

As used herein, the term "hopper" refers to that portion of the tailgate assembly of a rear loading refuse collection vehicle into which refuse may be deposited.

As used herein, the term "front", when used in reference to a vehicle, refers to the end of the vehicle where the cab is located. When used in reference to a container that is mounted or mountable on a vehicle, the term "front" refers to the end of the container nearest the cab of the vehicle when the container is mounted thereon.

As used herein, the term "rear", when used in reference to a vehicle (or to a container that is mounted or mountable on a vehicle), refers to the end of the vehicle (or the container) opposite the front end.

SUMMARY OF THE INVENTION

The invention comprises a rear loading refuse collection vehicle having a rear tailgate assembly and a detachably mounted container having a rear wall which is provided with an opening and a sweep panel mounted over the opening. The sweep panel may be moved between an open position which exposes the opening and a closed position which covers the opening. Opening of the sweep panel provides a path to the storage container for refuse material that is deposited in the hopper of the tailgate assembly of the vehicle. The tailgate assembly includes a packer assembly which is adapted to cooperate with the sweep panel to move refuse material from the hopper into the storage container. In a preferred embodiment of the invention, the sweep panel and the tailgate assembly are arranged and configured so as to minimize the spilling of refuse from the opening of the storage container into the hopper as the sweep panel is moved from the open position to the closed position.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
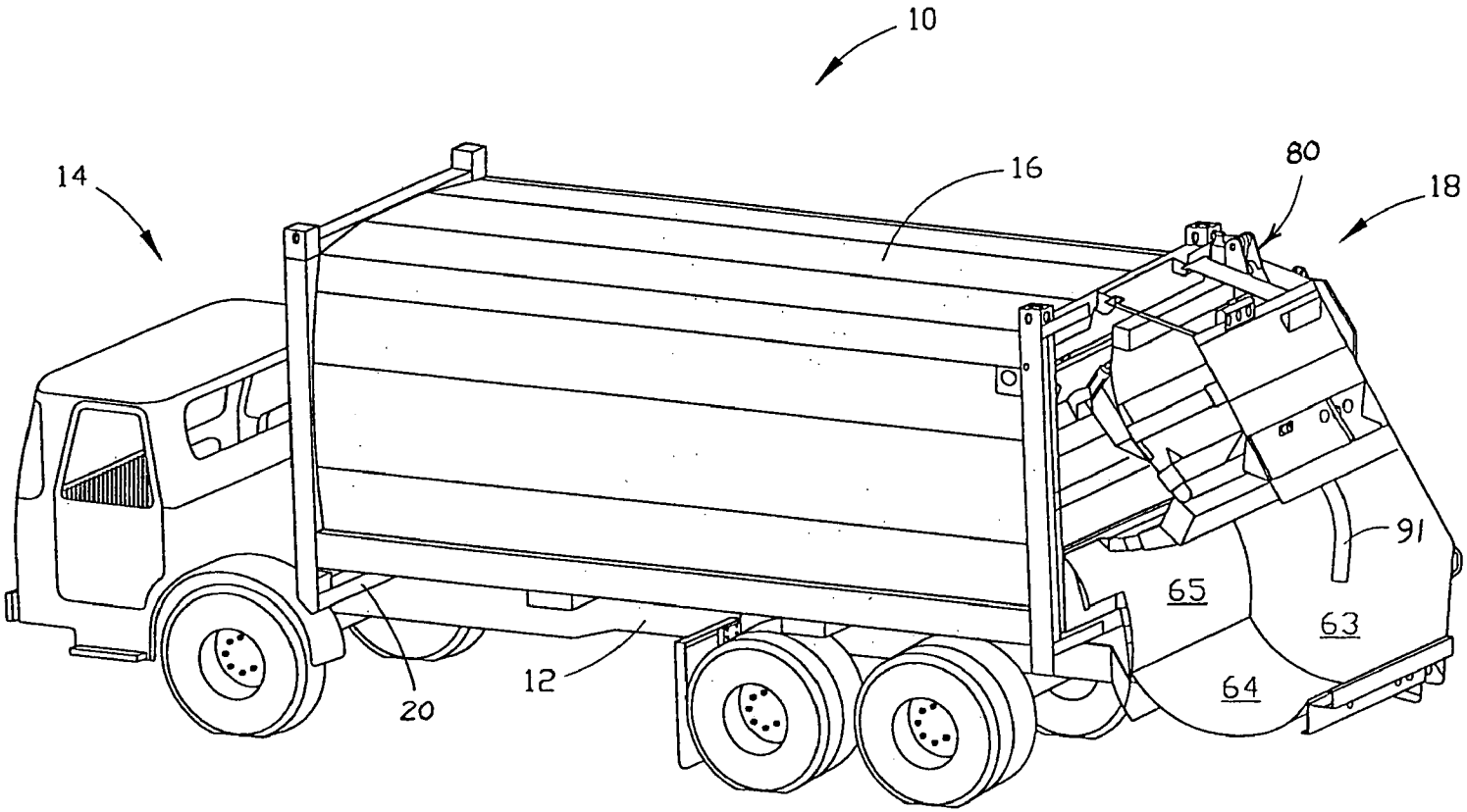
FIG. 1 is a rear perspective view of a preferred rear loading refuse collection vehicle constructed according to the invention, with the preferred tailgate assembly shown in partial section.
Figure 3:
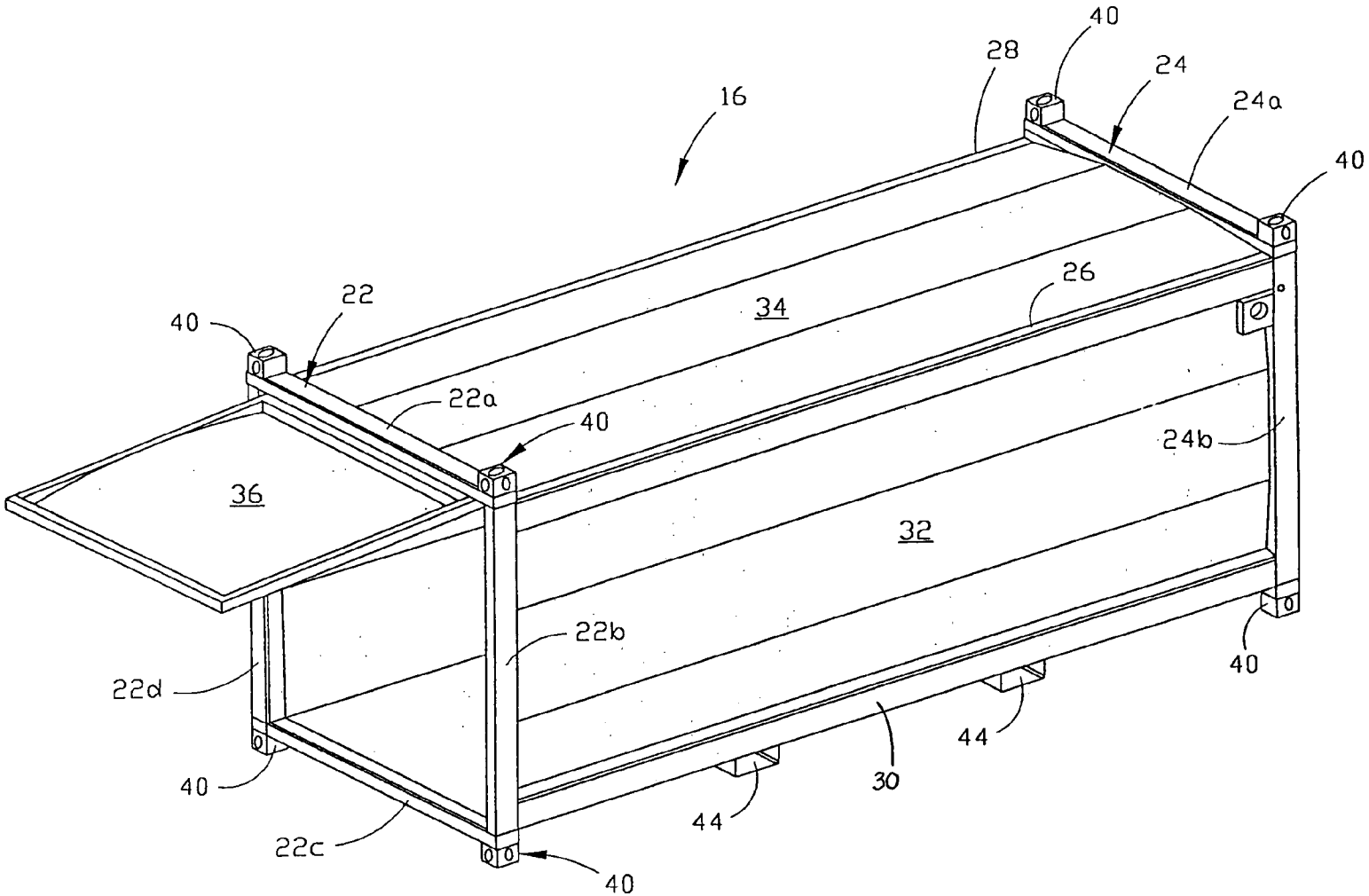
FIG. 3 is a front perspective view of the removable container that is a part of the preferred embodiment of the invention illustrated in FIG. 1.
Figure 4:
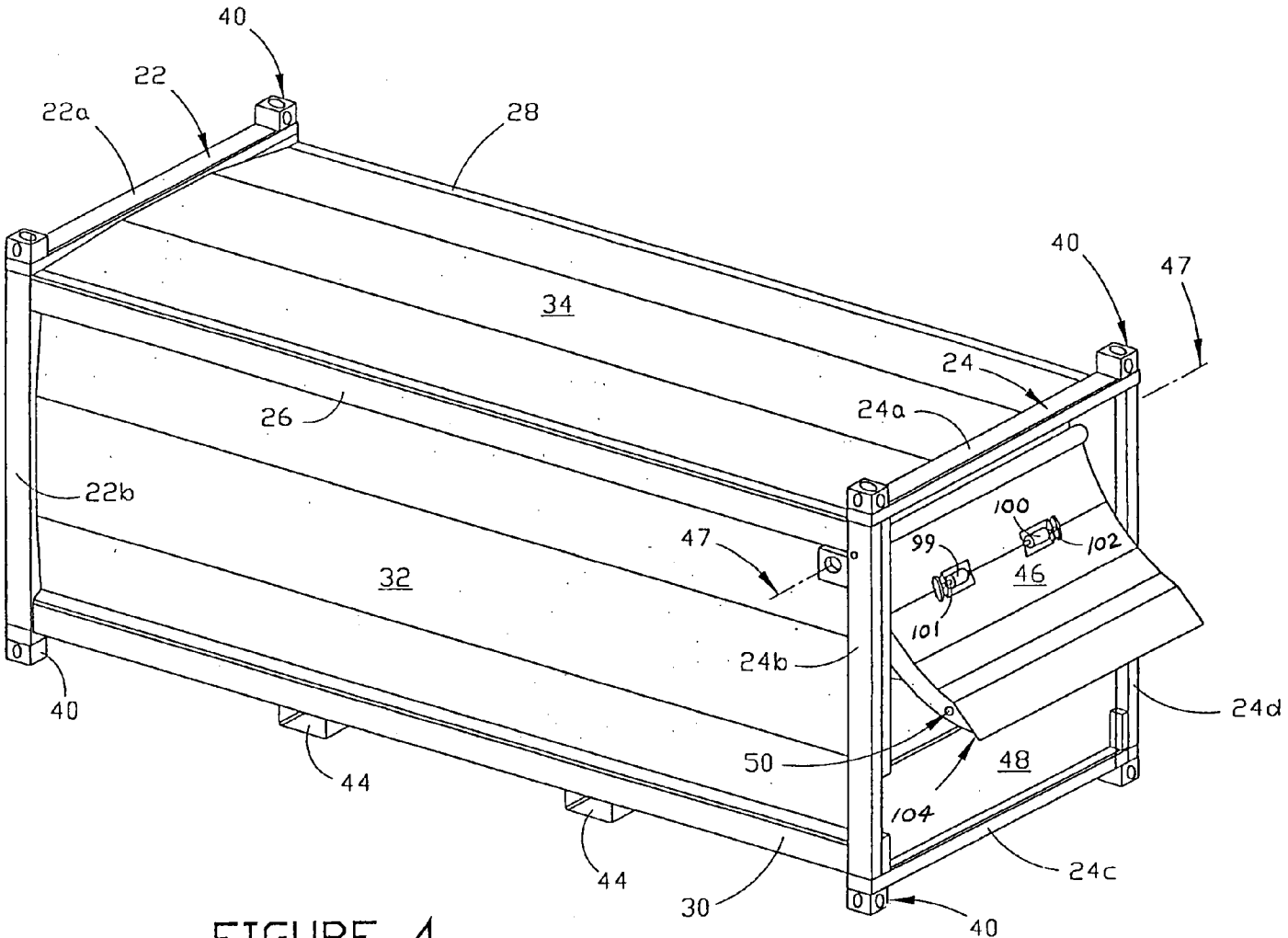
FIG. 4 is a rear perspective view of the removable container that is a part of the preferred embodiment of the invention illustrated in FIG. 1.

As shown in FIG. 1, preferred vehicle 10 includes chassis 12, cab 14, container 16 and tailgate assembly 18. The chassis includes at least one cross-member 20 (best shown in FIG. 5) for supporting a container of a particular length at or near its front end, and may include a similar cross-member (not shown) for supporting the container at or near its rear end. The chassis may also include additional cross-members (not shown) for supporting containers of different lengths. As shown in FIGS. 1 and 3–6, preferred container 16 includes a supporting frame having a pair of generally rectangular end pieces 22 and 24, each of which is comprised of four interconnecting frame components 22*a*, 22*b*, 22*c* and 22*d*, and 24*a*, 24*b*, 24*c* and 24*d* respectively (FIGS. 3 and 4). End pieces 22 and 24 are preferably connected by a pair of top rails 26 and 28 and a pair of bottom rails (only one of which, bottom rail 30, is shown in the drawings). As shown in FIGS. 3 and 4, in the preferred embodiment of the invention, one of each pair of rails is located on either side of the container body; however, in an alternative embodiment (not shown), the top rails may be omitted. The container body is comprised of a pair of container sidewalls (only one of which, sidewall 32 is shown), top wall 34, a bottom wall (not shown), front wall 36 and rear wall 38. One or more bottom rails 39 (FIG. 5) may be provided to reinforce the bottom of the container. The side rails, bottom rails and frame components of the end pieces are preferably comprised of formed channels or tubing having a square or rectangular cross-section, and the walls are preferably comprised of steel or aluminum sheet. At the corners of end pieces 22 and 24 are located lock receivers, such as corner castings 40, that are adapted to receive locks 42 which are located at the ends of the cross-members 20 and adapted to secure the container to the chassis. The corner castings may also be employed in lifting and transporting the container. In addition, the container may be lifted by a fork lift using lift channels 44.

Figure 5:
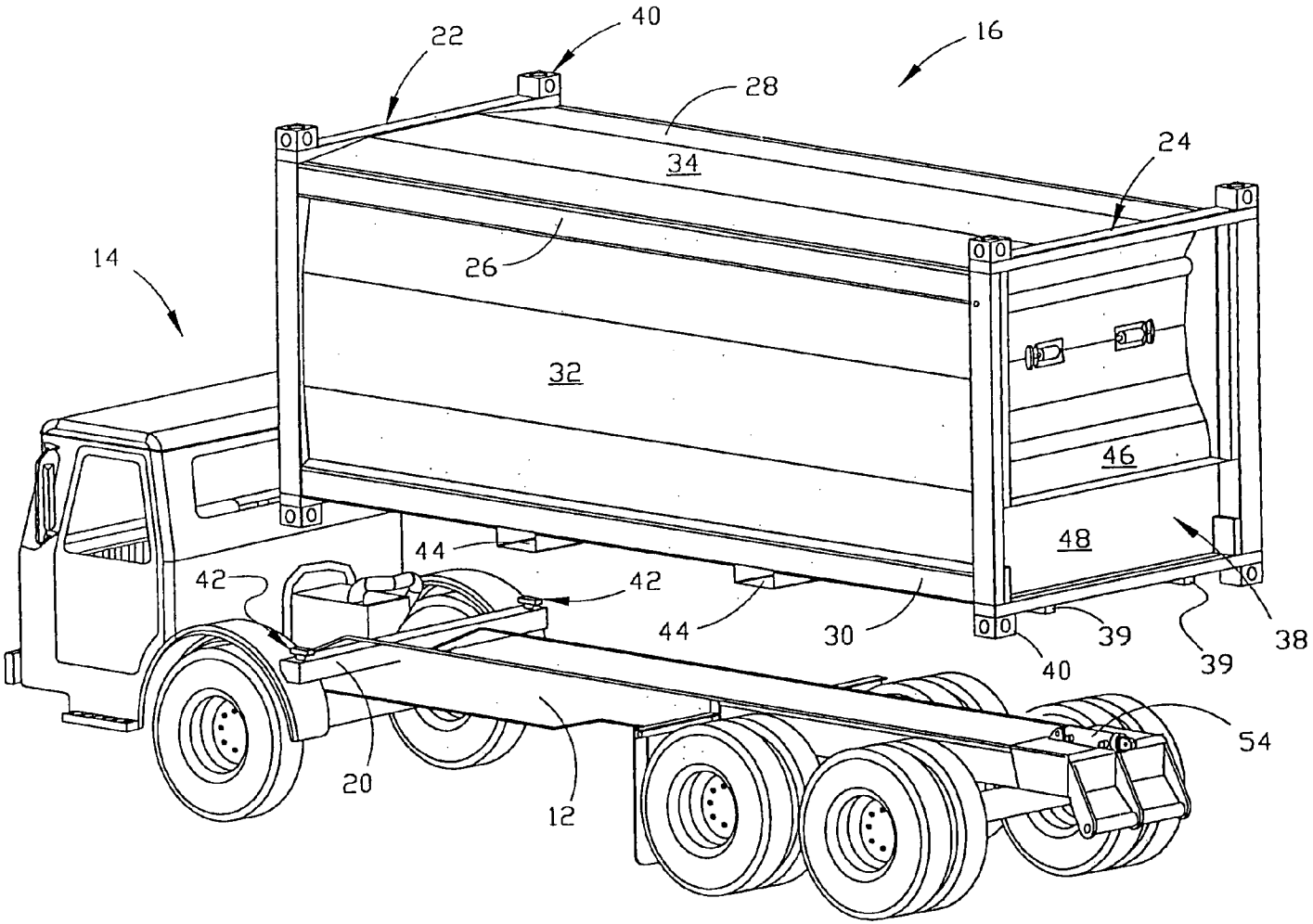
FIG. 5 is a rear perspective view of the preferred vehicle of FIG. 1, with the tailgate assembly removed and the container raised above the chassis of the vehicle.

As shown in FIG. 3, front wall 36 of preferred container 16 is hinged at the top so that it may swing open to allow for removal of refuse therefrom, as by, for example, tilting the container. The bottom of front wall 36 is also preferably provided with a sealing mechanism to seal against liquids (not shown) and locking pins (also not shown) that engage with holes (also not shown) in end piece 22 or other means of locking the front wall with respect to the end piece to allow for transport and temporary storage of refuse within the container. Rear wall 38 of preferred container 16 is provided with an opening and a sweep panel 46 that is pivotally attached at the top of the end wall along pivot axis 47 (FIG. 4). As illustrated in FIGS. 4 and 5, the sweep panel is movable between an open position which exposes the opening in the rear wall (FIG. 4) and a closed position which covers the opening in the rear wall (FIG. 5). Preferably, the rear wall is also provided with fixed dam 48 in order to minimize the risk that liquids will spill out of the container when it is being used to transport or store refuse. The sweep panel is also preferably adapted to be fixed in place in its closed position (shown in FIG. 5) by pins (not shown) which may be pneumatically actuated to engage holes 50 (only one of which is shown in FIG. 4) on opposite sides of the sweep panel. Opening of sweep panel (as hereinafter explained in more detail), as shown in FIG. 4, will expose the opening therebeneath (and above dam 48) through which refuse may be placed into the container.

Figure 6:
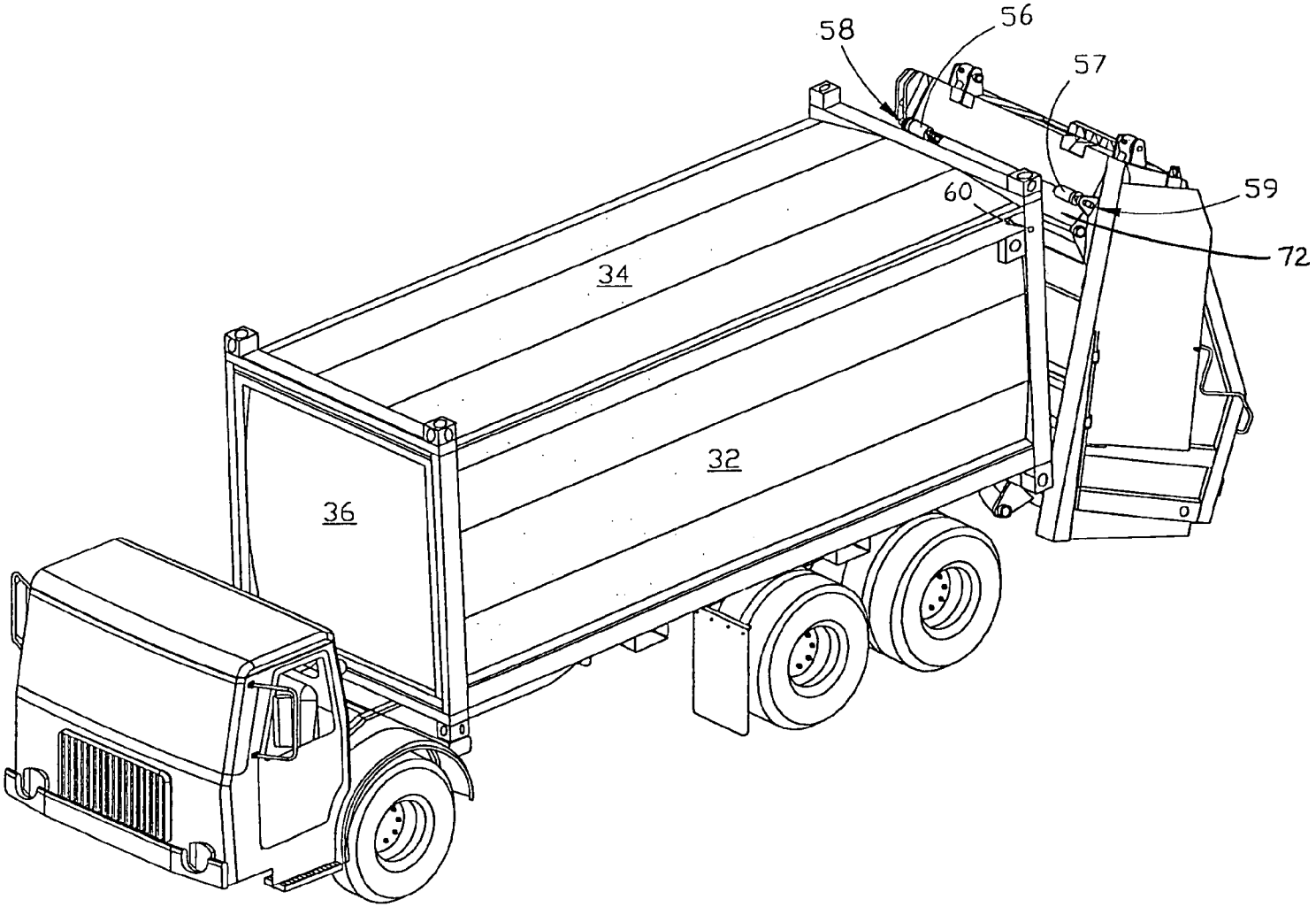
FIG. 6 is a front perspective view of the preferred vehicle of FIG. 1, showing the tailgate assembly tilted back from the container to permit easy removal of the container from the vehicle.
Figure 7:
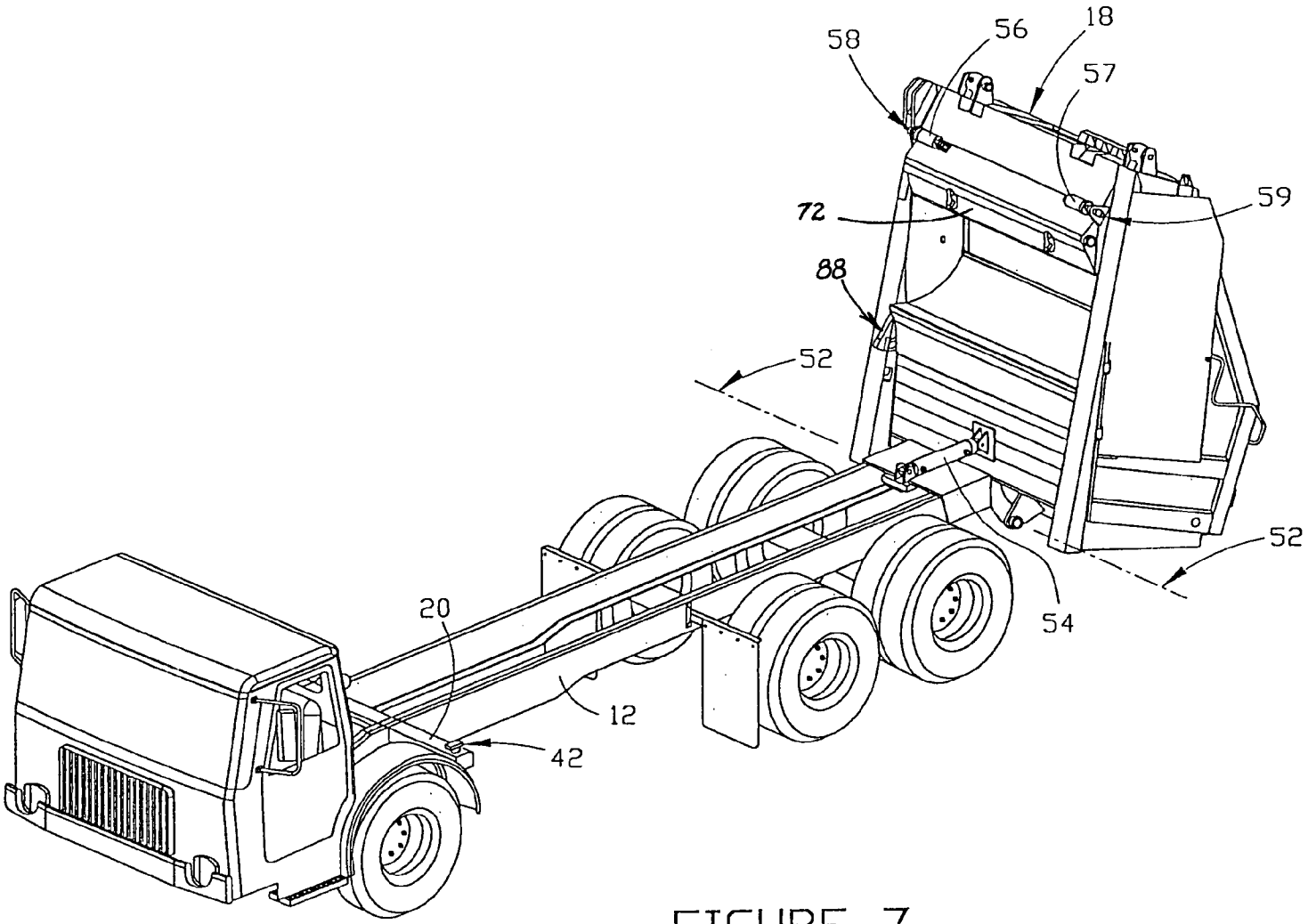
FIG. 7 is a front perspective view of the preferred embodiment of the vehicle illustrated in FIGS. 1, 5 and 6, with the container removed.
Figure 8:
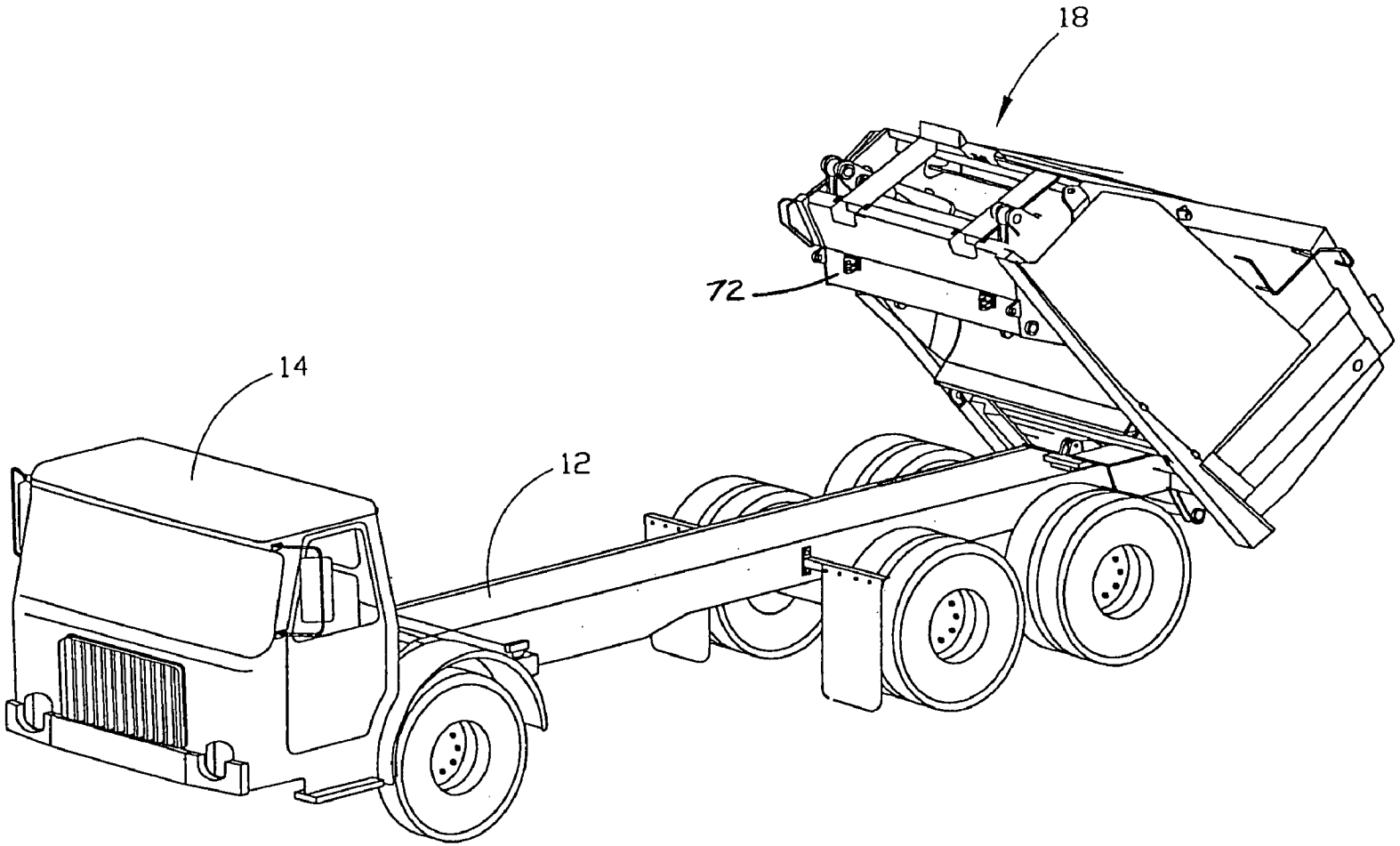
FIG. 8 is a partial front perspective view of the a portion of the preferred embodiment of the vehicle illustrated in FIGS. 1 and 5–7, showing the tailgate assembly tilted forward for travel without a container mounted on the chassis.

As best shown in FIG. 7, preferred tailgate assembly 18 is pivotally mounted to chassis 12 along pivot axis 52. This tailgate assembly is a modified version of the tailgate of U.S. Pat. No. Re. 33,602 of Smith. Hydraulic actuator 54 is preferably attached between chassis 12 and the tailgate assembly and is adapted to pivot the tailgate assembly so as to permit container 16 to be removed from the vehicle, as shown in FIG. 6. With the container removed, the tailgate assembly may be tilted forward for travel, as shown in FIG. 8. In an alternative embodiment illustrated in FIG. 9, tailgate 118, identical to tailgate 18 except for the addition of roller 120, may be tilted rearwardly so that roller 120, or a similar structure including one or more wheels, may rest on and roll along the road surface for travel with the container removed. As shown in FIGS. 6 and 7, preferred tailgate assembly 18 includes locking mechanisms for attaching the tailgate assembly to the container. The preferred locking mechanisms are a pair of pneumatic or hydraulic actuators 56 and 57, which are adapted to engage pins 58 and 59 into holes (only one of which, hole 60, is shown in FIG. 6) in end piece 24 of container 16.

Figure 2:
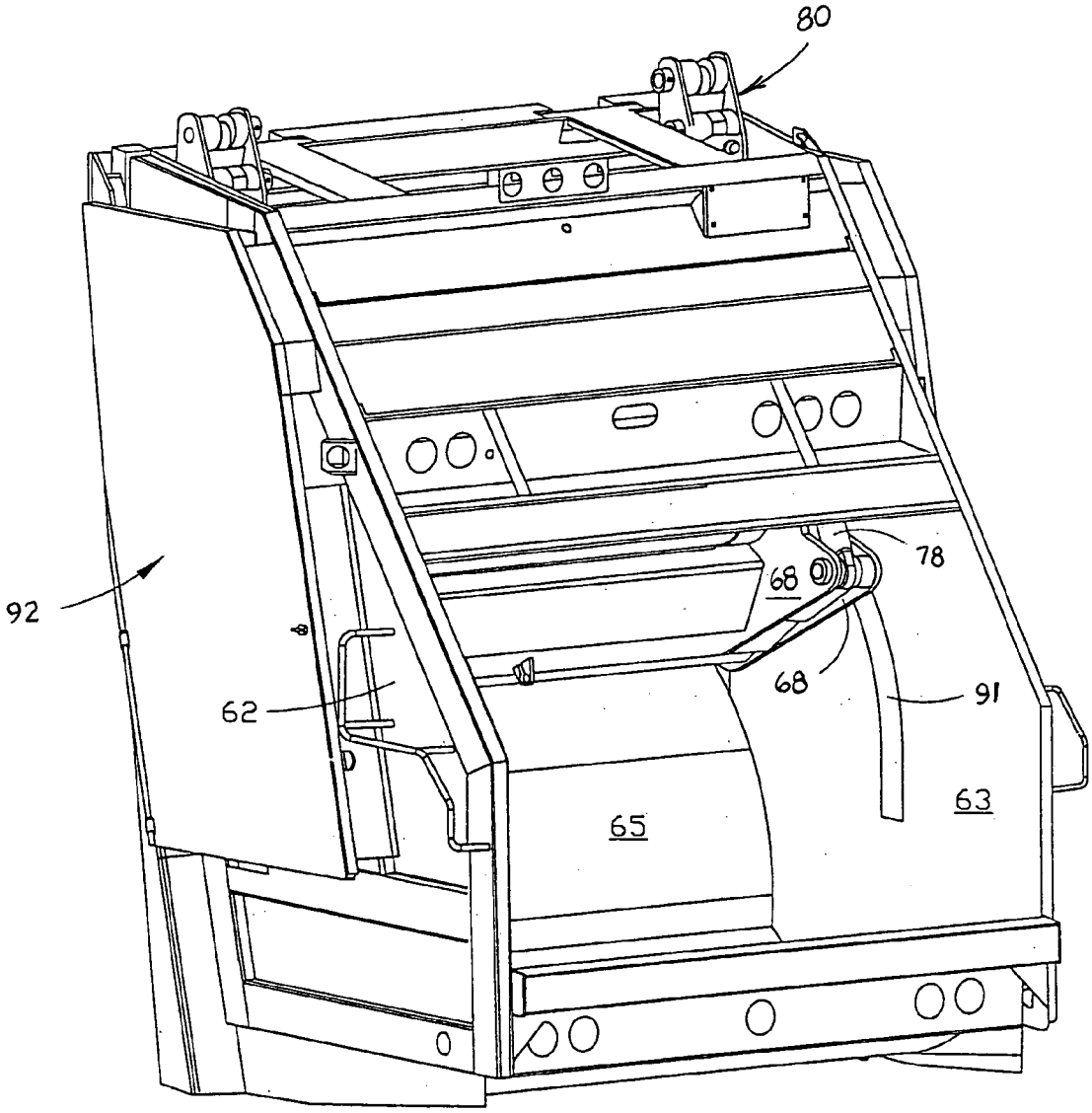
FIG. 2 is a rear perspective view of the preferred tailgate assembly of the vehicle of FIG. 1.
Figure 9:
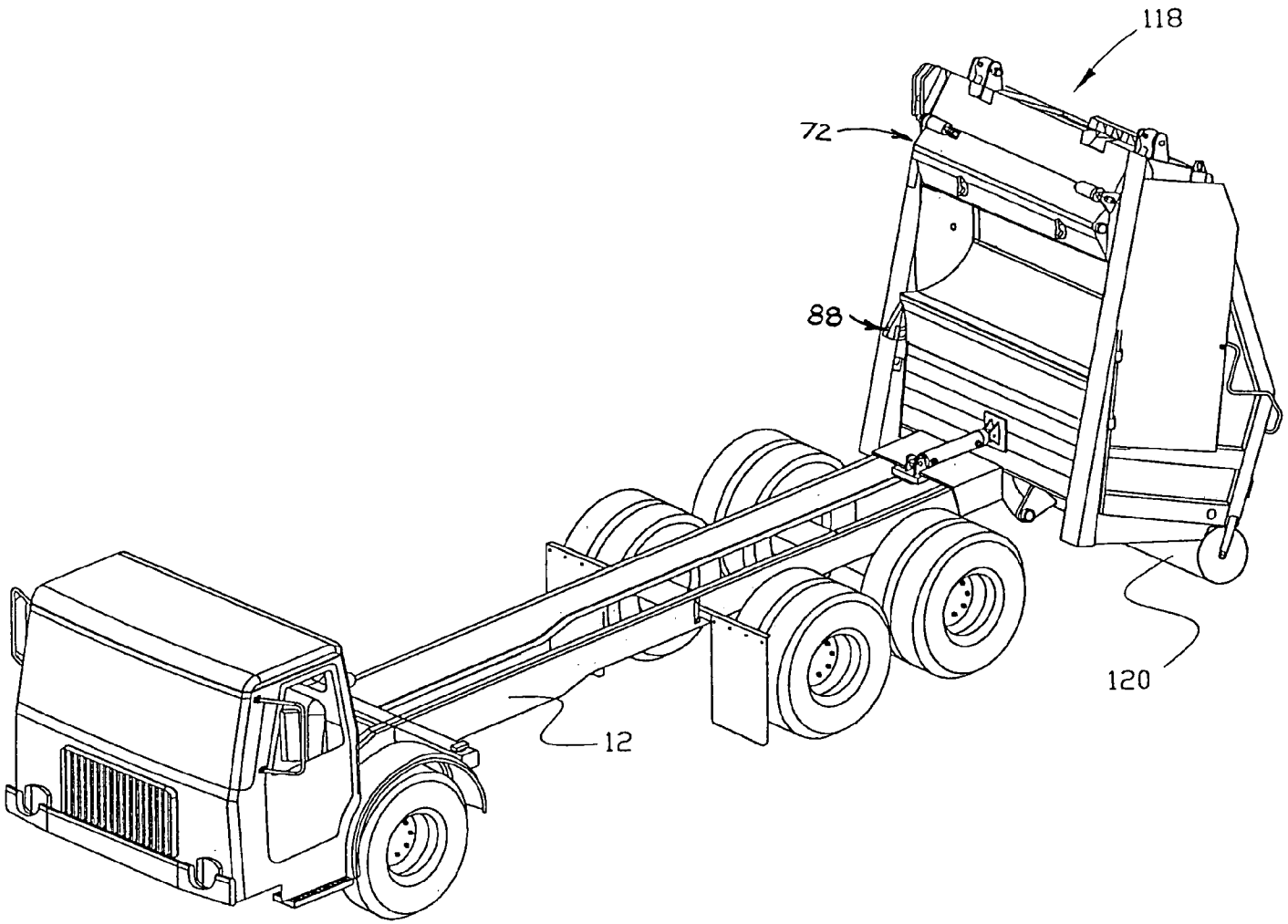
FIG. 9 is a front perspective view of an alternative embodiment of the vehicle illustrated in FIGS. 1 and 5–8, showing an alternative tailgate assembly that may be tilted backward for travel without a container mounted on the chassis.
Figure 10:
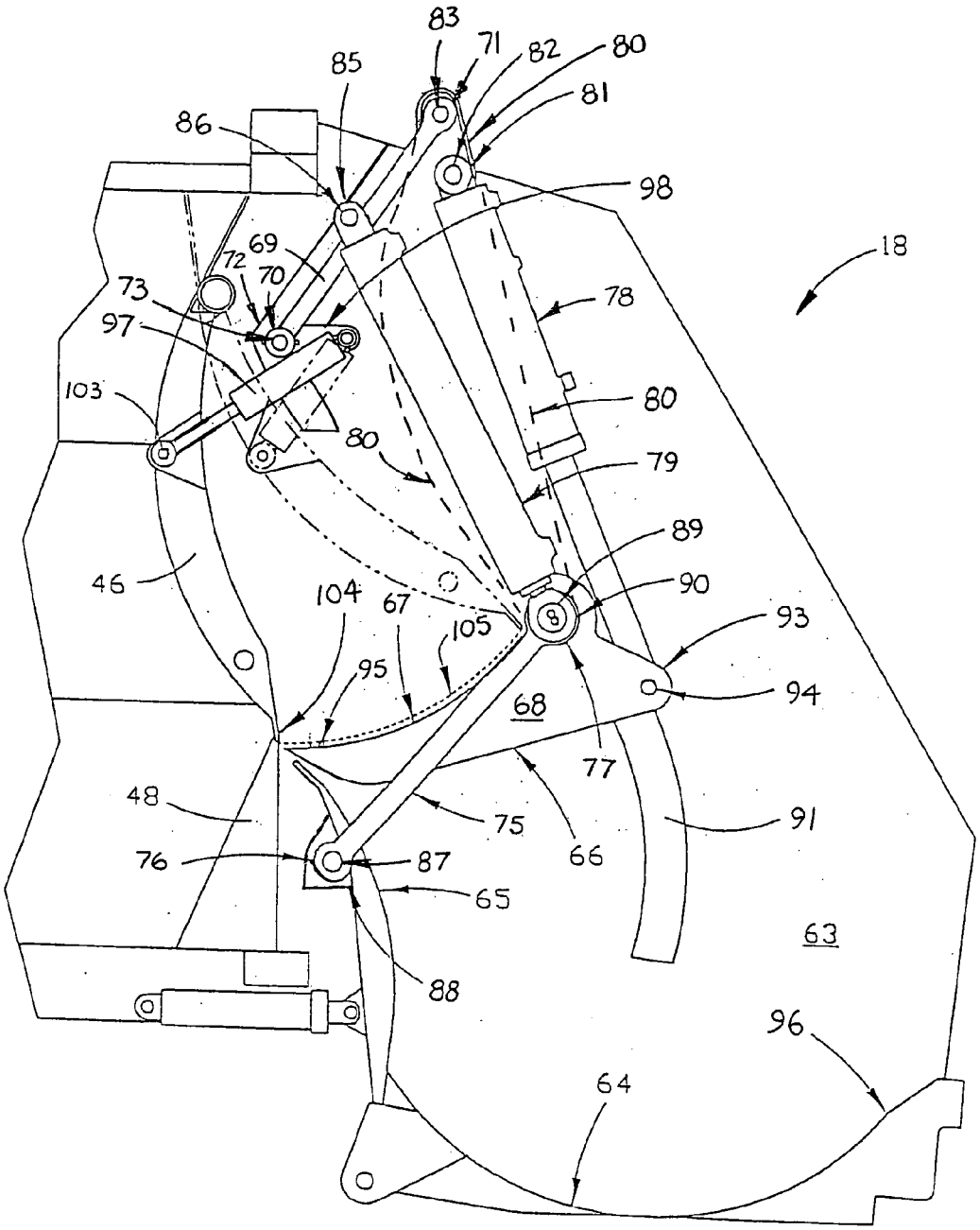
FIG. 10 is a partial side view (with an exterior enclosure and a sidewall of the tailgate removed) of preferred tailgate assembly of the embodiment of the invention illustrated in FIGS. 1, 2 and 5–8.

Referring now to FIGS. 1, 2 and 10–12, tailgate 18 includes a hopper into which refuse may be deposited from the rear of vehicle 10. The hopper is defined by tailgate sidewalls 62 and 63, hopper floor 64 and front plate 65. The front plate preferably extends in an arcuate configuration to the top of dam 48 on rear wall 38 (see FIG. 5) of container 16. The tailgate assembly includes a packer assembly which is adapted to cooperate with the sweep panel of the container to move refuse from the hopper into container 16. As best shown in FIG. 10, the preferred packer assembly includes packer 66 comprised of packer panel 67 and a plurality of packer end plates 68 (only one of which is shown in FIG. 10). The preferred packer assembly also includes a pair of upper links 69 (only one of which is shown in FIG. 10), each having a first end 70 and a second end 71. First end 70 of link 69 is pivotally attached to upper support panel 72 at pivot 73. Upper support panel 72 extends across the width of tailgate 18, as shown in FIGS. 6–9. The preferred packer assembly also includes a pair of lower links 75 (only one of which is shown in FIG. 10), each having a first end 76 and a second end 77, a first pair of hydraulic actuators 78 (only one of which is shown in FIG. 10) and a second pair of hydraulic actuators 79 (only one of which is shown in FIG. 10). Upper panel 80 extends across the width of the tailgate, and the first actuators are attached at their base ends on opposite sides of the upper panel. Thus as shown in FIG. 10, base end 81 of actuator 78 is preferably pivotally attached at pivot mount 82 to the upper end of upper panel 80 (the major portion of which is shown in dashed lines in FIG. 10). In addition, the second end 71 of link 69 is preferably pivotally attached at pivot mount 83 to the upper end of upper panel 80 above pivot mount 82. The base end 85 of second actuator 79 is preferably pivotally attached to pivot mount 86 on the outside of the sidewall of tailgate 18. Each of the lower links (such as link 75) is preferably pivotally attached at a first end (such as end 76) to a pivot (such as pivot 87) on an extension bracket (such as bracket 88) that is attached to the sidewall of the tailgate assembly in front of front plate 65. An identical bracket 88, located on the other side of the tailgate from that shown in FIG. 10, is shown in FIGS. 7 and 9. A pair of connecting rods (one of which, connecting rod 89, is shown in FIG. 10) are also provided to connect each of the lower links at their second ends to the extension ends of the second actuators and to the lower end of the upper panel 80. As shown in FIG. 10, connecting rod 89 extends from a bushing within the lower end of upper panel 80, through the packer end plates (such as end plate 68) at an intermediate position, through second end 77 of lower link 75, through extension end 90 of second actuator 79, and through the curved slot (such as slot 91) in the sidewall of the tailgate assembly. A similar connecting rod connects the same components on the other side of the tailgate. The lower links 75 and hydraulic actuators 79 attached thereto are located within exterior enclosures (only one of which, enclosure 92, is shown in FIG. 2). The extension end 93 of each of actuators 78 is preferably attached to a pair of packer end plates (such as plates 68 shown in FIGS. 2 and 10) at the rear end pivot point (such as pivot point 94 of FIG. 10). The motion of packer panel 67 within the tailgate assembly is defined by the configuration of packer panel 67 and packer end plates 68, and by the cooperation of these components with the upper links (such as link 69), lower links (such as link 75), upper panel 80, connecting rods (such as rod 89) and the slots in the sidewalls of the tailgate assembly (such as slot 91 in sidewall 63), along with the action of the first actuators (such as actuator 78) and the second actuators (such as actuator 79).

FIG. 10 shows the normal configuration of the components of the tailgate assembly when refuse is placed in the hopper. After placing refuse in the hopper, retraction of the first actuators (including actuator 78) and extension of the second actuators (including actuator 79) would move packer panel 67 so that front end 95 would be located at the rear end 96 of hopper floor 64. Extension of the first actuators (including actuator 78) would then cause front end 95 of packer panel 67 to follow the contours of hopper floor 64 to its intersection with front plate 65, sweeping any refuse in the hopper before it. Retraction of the second actuators (including actuator 79) will then cause front end 95 of packer panel 67 to follow the contours of front plate 65, carrying refuse from the hopper up to and through the opening in the container created by the opening of sweep panel 46 (see also FIG. 11). In the preferred embodiment of the invention, one end of each of a pair of hydraulic actuators (one of which, actuator 97, is shown in FIG. 10) is connected to bracket 98 that is attached to upper support panel 72 of tailgate 18. The other ends of the actuators are attached to sweep panel 46 by a pair of pneumatic cylinders 99 and 100 (FIGS. 4 and 5), which are adapted to engage pins 101 and 102 into holes (only one of which, hole 103, is shown in FIG. 10) in the ends of the hydraulic actuators. As understood by comparing FIGS. 11 and 12 and the representations of sweep panel 46 in solid lines and dashed lines in FIG. 10, extension of the hydraulic actuators attached to sweep panel 46 will cause the sweep panel to move from the open position of FIG. 11 (corresponding to the representation of sweep panel 46 in dashed lines in FIG. 10) to the closed position of FIG. 12 (corresponding to the representation of sweep panel 46 in solid lines in FIG. 10). As the actuators are extended, lower end 104 of panel 46 will follow the contours of packer panel 67 (corresponding to dashed line 105 of FIG. 10) and sweep any refuse material retained thereon into the container. Thus, the arrangement and configuration of the preferred sweep panel and packer assembly results in cooperation between the sweep panel and the packer assembly as the sweep panel is moved from the open position to the closed position to move refuse material from the hopper of the tailgate assembly into the storage container, while substantially eliminating or minimizing the spilling of refuse material from the opening of the storage container into the hopper. The action of the sweep panel in sweeping across the packer panel will also assist in packing refuse in the container, and it will serve to close off the container so that it may be removed from vehicle 10.

Figure 11:
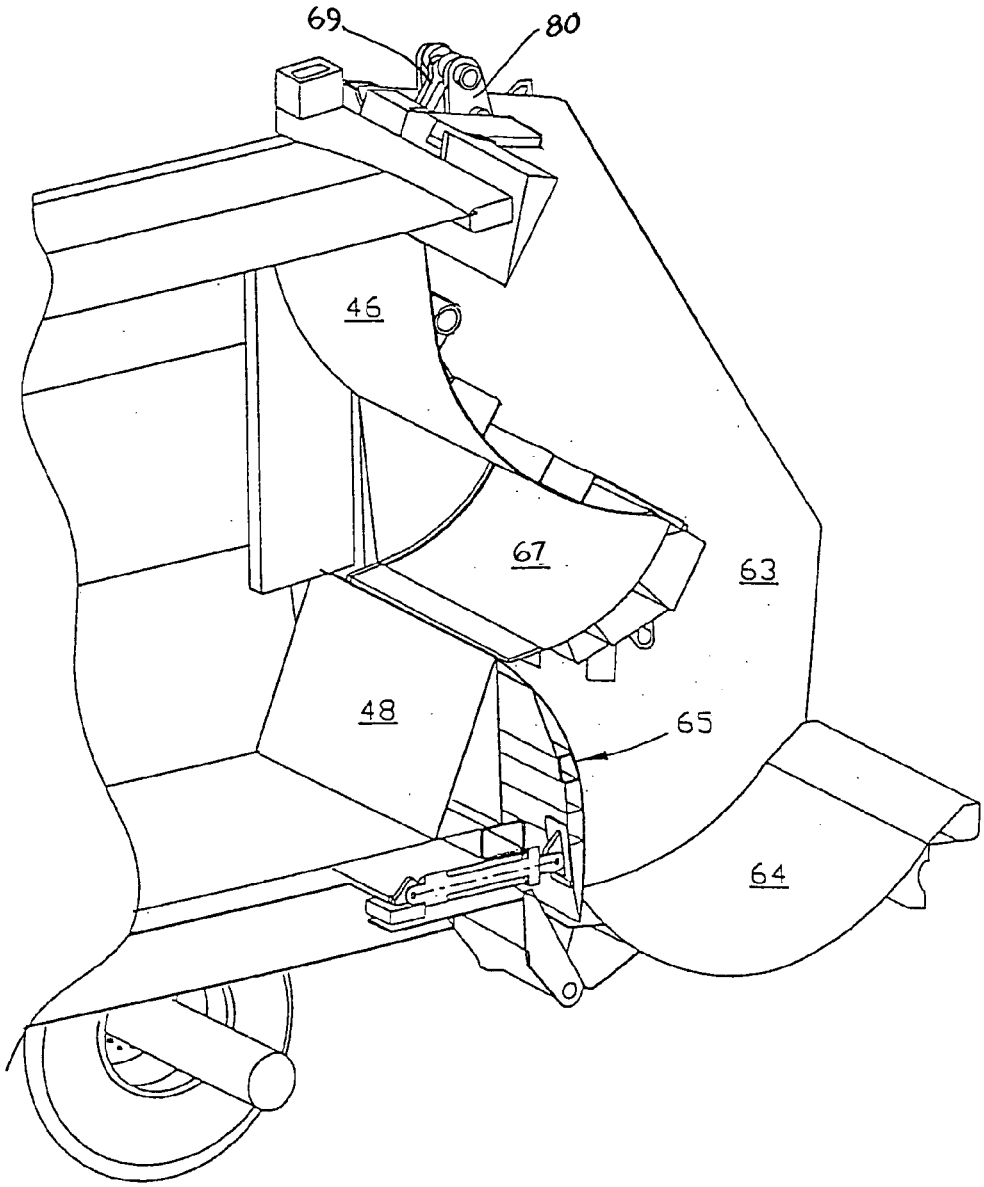
FIG. 11 is a front perspective cut-away view of the preferred tailgate assembly and container showing the sweep panel of the container in the open position.
Figure 12:
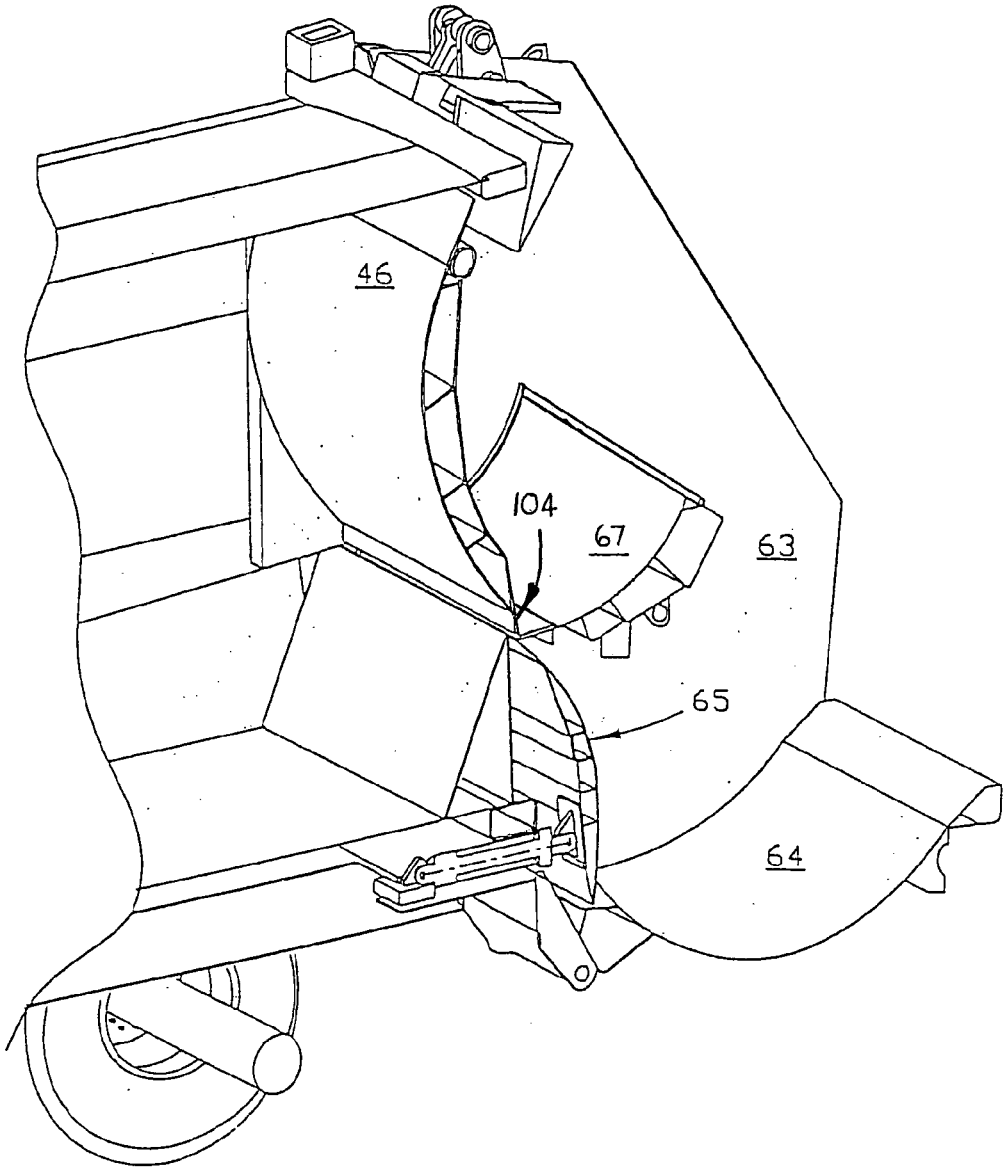
FIG. 12 is a front perspective cut-away view of the preferred tailgate assembly and container showing the sweep panel of the container in the closed position.

Preferably, the actuators attached to the sweep panel are double acting hydraulic actuators which are adapted to move the sweep panel between the open and the closed positions illustrated by FIGS. 11 and 12. However, it is also contemplated that other mechanical actuators could be employed to move the sweep panel between the open and closed positions. Thus, for example, a motor (not shown) could be provided to move the sweep panel between the open and closed positions. The sweep panel could also be mounted on a shaft along axis 47 (FIG. 4) having a torsion spring thereon that is adapted to hold the sweep panel in either the open or the closed position. A motor, single acting hydraulic actuator, lever or ratcheted gear system could be employed to move the sweep panel against the action of the torsion spring.

It is also contemplated within the scope of the invention that the various hydraulic actuators employed in the packer assembly of the invention could be replaced by pneumatic actuators, motorized drives or other mechanical actuators for moving the packing panel within the hopper. Similarly, it is contemplated within the scope of the invention that the various pneumatic actuators employed in the invention could be replaced by hydraulic actuators, spring loaded pins or other mechanical actuators for engaging pins with corresponding holes. It is also contemplated that the scope of the invention includes refuse collection vehicles having rear loading packing mechanisms that are different from the preferred packer assembly described herein, such as (but not limited to) those having augers or swinging platens or those having guiding slides instead of links 69 and 75.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A refuse collection vehicle comprising:

(a) a chassis;

(b) a storage container that is detachably mounted on the chassis, said storage container having a rear wall with an opening therein and a sweep panel that is pivotally mounted in the rear wall, said sweep panel being movable between an open position which exposes the opening in the rear wall of the container and a closed position which covers the opening in the rear wall of the container;

(c) a rear tailgate assembly that is mounted to the chassis, said tailgate assembly comprising:

(i) an actuator that is detachably mounted to the sweep panel for moving the sweep panel between the open position and the closed position;

(ii) a hopper which is adapted to receive refuse, said hopper being defined by a pair of tailgate sidewalls with a hopper floor extending between the sidewalls;

(iii) a front plate that extends between the sidewalls;

(iv) an extension bracket that is attached to one of the sidewalls of the tailgate assembly in front of the front plate;

(v) a pivot mount on the outside of the sidewall;

(vi) a packer assembly which is adapted to move refuse from the hopper of the tailgate assembly to the opening in the rear wall of the storage container when the sweep panel of the storage container is in the open position, said packer assembly comprising:

(A) a packer panel that extends between the sidewalls of the tailgate;

(B) a packer end plate that is attached to the packer panel and has a rear pivot point;

(C) an upper support panel that extends between the sidewalls of the tailgate;

(D) an upper panel that extends between the sidewalls of the tailgate and is mounted behind the upper support panel;

(E) an upper link having a first end and a second end, said first end being pivotally attached to the upper support panel and said second end being pivotally attached to the upper end of the upper panel;

(F) a connecting rod that is mounted between the sidewalls of the tailgate;

(G) a lower link having a first end and a second end, said first end being pivotally attached to the extension bracket and said second end being pivotally attached to the connecting rod;

(H) a first actuator having a base end and an extension end, said base end being pivotally attached to the upper end of the upper panel below the attachment for the second end of the upper link, and said extension end being pivotally attached to the rear pivot point of the packer end plate;

(I) a second actuator having a base end and an extension end, said base end being pivotally attached on the outside of the sidewall of the tailgate and said extension end being attached to the connecting rod.

2. A method for loading refuse in a storage container that is detachably mounted to the chassis of a vehicle, said storage container having a rear wall with an opening therein and a sweep panel that is mounted in the rear wall, said sweep panel being movable between an open position which exposes the opening in the rear wall of the container and a closed position which covers the opening in the rear wall of the container, wherein said method comprises:

(a) providing a rear tailgate assembly that is mounted to the chassis of the vehicle, said tailgate assembly comprising:

(i) a hopper which is adapted to receive refuse, said hopper being defined by a pair of tailgate sidewalls with a hopper floor extending between the sidewalls;

(ii) an actuator that is detachably mounted to the sweep panel for moving the sweep panel between the open position and the closed position;

(iii) a packer assembly which is adapted to move refuse from the hopper of the tailgate assembly to the opening in the rear wall of the storage container when the sweep panel of the storage container is in the open position;

(b) attaching the actuator of the tailgate assembly to the sweep panel;

(c) moving the sweep panel of the storage container to the open position;

(d) loading refuse into the hopper of the tailgate assembly;

(e) moving the sweep panel to the closed position, thereby sweeping refuse into the container.

3. The method of claim 2 which includes the step of moving the sweep panel across the packer panel to the closed position to sweep refuse into the container.

* * * * *